US005518054A

United States Patent [19]

Mitson et al.

[11] Patent Number: 5,518,054

[45] Date of Patent: May 21, 1996

[54] PROCESSING AIDS FOR GAS GENERANTS

[75] Inventors: Scott C. Mitson, Honeyville; Robert D. Taylor, Hyrum; Thomas M. Deppert; Michael W. Barnes, both of Brigham City, all of Utah

[73] Assignee: Morton International, Inc., Chicago, Ill.

[21] Appl. No.: 324,188

[22] Filed: Oct. 4, 1994

Related U.S. Application Data

[63] Continuation-in-part of Ser. No. 207,922, Mar. 8, 1994, which is a continuation-in-part of Ser. No. 165,133, Dec. 10, 1993, abandoned.

[51] Int. Cl.[6] ..... C06B 35/00; C06B 45/12

[52] U.S. Cl. ..... 149/35; 102/287; 102/290

[58] Field of Search ..... 162/287, 290; 149/35

[56] References Cited

U.S. PATENT DOCUMENTS

| | | | |
|---|---|---|---|
| 2,197,707 | 4/1940 | Crittenden et al. | 23/212 |
| 2,539,012 | 1/1951 | Diamond et al. | 99/143 |
| 3,834,955 | 9/1974 | Fox et al. | 149/7 |
| 4,369,079 | 1/1983 | Shaw | 149/2 X |
| 4,370,181 | 1/1983 | Lundstrom et al. | 149/2 X |
| 4,909,549 | 3/1990 | Poole et al. | 280/738 |
| 4,931,111 | 6/1990 | Poole et al. | 149/35 |
| 4,931,112 | 6/1990 | Wardle et al. | 149/88 |
| 5,084,118 | 1/1992 | Poole | 149/22 |
| 5,197,758 | 3/1993 | Lund et al. | 149/61 X |
| 5,431,103 | 7/1995 | Hock et al. | 102/287 |

FOREIGN PATENT DOCUMENTS

| | | | |
|---|---|---|---|
| 0519485 | 6/1992 | European Pat. Off. | C06D 5/06 |
| 0536525 | 8/1992 | European Pat. Off. | C06D 5/06 |
| 2663628 | 12/1991 | France | C06D 5/06 |

*Primary Examiner*—Peter A. Nelson

*Attorney, Agent, or Firm*—Wayne E. Nacker; Gerald K. White

[57] ABSTRACT

In a gas generant composition for automotive airbag inflation, a gas generant composition comprises a fuel and an oxidizer the composition includes a metal oxide or metalloid oxide and a processing aid which is a mixture of mica and a salt of a fatty acid.

5 Claims, No Drawings

PROCESSING AIDS FOR GAS GENERANTS

REFERENCE TO RELATED CASES

This application is a continuation-in-part of Ser. No. 08/207,922 filed on Mar. 8, 1994, which is a continuation-in-part of Ser. No. 08/165,133, filed on Dec. 10, 1993, and now abandoned.

The present invention is directed to gas generants, such as are used in automotive airbag inflators, and particularly to processing aids for gas generants which contain high levels of metal oxides present as hard particles. Such metal oxides may function as oxidizers, slag modifiers, or as simple flow agents.

BACKGROUND OF THE INVENTION

Gas generant formulations for automotive airbags contain as a minimum, a fuel and an oxidizer. Additionally it may contain other ingredients to modify the nature of the slag produced in the combustion process, to increase the burning rate, to cool the composition, or to function as a processing aid. Such formulations are commonly formed into pellets for insertion into an inflator device by rotary pressing equipment or other pressing equipment using a system of dies and punches as described for example in U.S. Pat. Nos. 4,561,675 and 4,547,342, the teachings of each of which are incorporated herein by reference. Gas generants containing significant levels of metal oxides present as hard particles are pressed into pellets with great difficulty as manifest by the high release load required to remove the pellets from the dies. This in turn is manifest in a high rate of wear on the dies and punches. It is common practice to include processing aids such as water, graphite powder, molybdenum disulfide, boron nitride, or salts of fatty acids into the formulations to reduce the force required to remove the pellets from the dies, and hence results in a reduction in tool wear which also reduces the cost of producing the gas generant. Many compositions cannot be mass produced into pellets without the use of a processing aid and thus processing aids are a very important part of the gas generant formulation.

It is recognized by those skilled in the art that processing aids themselves either become fuels, oxidizers, or inert ingredients within any gas generant formulation and contribute to the overall properties of the composition such as burning rate, mechanical strength, gas toxicity, and ability to form easily filterable slag. In general it is most desirable to use a processing aid at the lowest level possible. Blending the processing aid to a previously prepared gas generant powder of prilled composition rather than incorporating the processing aid into the bulk composition also greatly increases its effectiveness.

Salts of fatty acids (for example, calcium or magnesium stearate) used in formulations containing transition metal oxides have proven effective in decreasing mold release forces when used at levels in the range of 1% by wt. The same formulation by way of comparison requires from 1.5 to 3.0% by weight of molybdenum disulfide to produce a comparable effectiveness in decreasing mold release forces. The fatty acid salts, however, reduced the burning rate of the formulation to undesirable levels relative to formulations with molybdenum disulfide. For this particular composition it would be most desirable to have the effectiveness of the calcium stearate without the consequent loss of burning rate.

SUMMARY OF THE INVENTION

In accordance with the present invention, for a gas generant composition comprising a fuel and an oxidizer, and which also include a metal oxide or metalloid oxide, processing aids are used which are a mixture of mica and a salt of a fatty acid.

Such processing aid compositions are more effective than using fatty acid salt alone or mica alone. The synergistic effect of mica and fatty acid salt provides processing effectiveness at very low levels and avoids substantially the burning rate penalty of using the fatty acid salt alone.

DETAILED DESCRIPTION OF CERTAIN PREFERRED EMBODIMENTS

The gas generant formulations may be formulated with any known fuel. Most airbags today use an azide, particularly sodium azide as fuel. However, there is a desire to get away from the use of azide fuels and a number of other fuels have been proposed, including tetrazoles, such as 5-aminotetrazole, tetrazole, bitetrazole, metal salts of tetrazoles; 1,2,4-triazole-5-one, 3-nitro 1,2,4-triazole-5-one and metal salts of triazoles; dicyanamide; dicyandiamide; nitrates, such as guanidine nitrate, aminoguanidine nitrate, diaminoguanidine nitrate, semicarbazide nitrate, triaminoguanidine nitrate, ethylenediamine dinitrate and hexamethylene tetramine dinitrate. The fuel will typically comprise between about 15 and about 70 wt % of the gas generant composition. The oxidizer will typically comprise between about 20 and about 80 wt % of the gas generant composition.

The processing aids of the present invention are particularly suitable for gas generant compositions containing metal oxides and/or metalloid oxides, e.g. $SiO_2$. A transition metal oxide may serve as an oxidizer, either alone or in combination with other oxidizers such as ammonium, alkali, and alkaline earth metal nitrates, chlorates, peroxides, and perchlorates. Metal oxides and metalloid oxides useful as oxidizers in gas generant compositions include but are not limited to cuprous oxide, ferrous oxide, cupric chromate, chromium oxide, manganese oxide, cupric oxide, ferric oxide, aluminum oxide and silicon dioxide. Starting at about 5 wt % metal oxide or metalloid oxide, particularly at about 10 wt %, and very particularly at about 20 wt %, processing of such formulations become difficult. Gas generant formulations containing up to about 80 wt % transition metal oxides are known.

It is found that mica when used in conjunction with a salt of a fatty acid provides superior processing and release properties to metal oxide or metalloid oxide-containing gas generant compositions. The mica is not only a replacement for the amount of fatty acid salt which would otherwise be required, but also reduces the total amount of processing aid required. Thus, for example, it is found that a 0.25 wt % mica/0.25 wt % calcium stearate mixture provides release properties substantially equal to 1 wt % calcium stearate addition. Accordingly, the mica minimizes the adverse effects of fatty acid salt addition discussed above. Also, mica, in conjunction with a fatty acid salt, allows for dense compaction of the formulation.

Although "mica" is intended to include any of the minerals known as mica, including muscovite, phlogopite and biotite, muscovite is currently preferred. Small particulate sizes are required, i.e., the largest dimension should be no greater than 100 microns, preferably no greater than 50 microns and most preferably no greater than 20 microns.

The fatty acid salt is a salt of a fatty acid having between about 10 and about 30 carbon atoms. The cation may be an alkali metal, such as sodium or potassium, an alkaline earth metal, such as calcium or magnesium, or any other monovalent, divalent or trivalent metallic cation. Preferred cations are zinc, calcium and magnesium, calcium being most preferred.

The processing aid mixture of the present invention is used at between about 0.05 and about 2 wt % of the generant composition, preferably no more than about 1 wt % and most preferably no more than about 0.5 wt %. Depending upon the gas generant formulation the mica:fatty acid salt ratio may vary from about 4:1 to about 1:4.

The gas generant composition may optionally contain other components conventional in the art. The gas generant composition, for example, may optionally contain up to about 3 wt %, typically between about 1 and about 2 wt % of a combustion catalyst, such as boron hydrides and iron ferricyanide. Coolants may be included up to about 10 wt %, typically between about 1 and about 5 wt %. Suitable coolants include graphite, alumina, silica, metal carbonate salts, transition metals and mixtures thereof. The coolants may be in particulate form, although if available, fiber form is preferred, e.g., graphite, alumina and alumina/silica fibers.

The invention will now be described in greater detail by way of specific example.

EXAMPLE 1

A gas generant formulation of 76.6 wt % CuO, 23.4 wt % 5-aminotetrazole (5AT) was prepared. Based on the weight of the generant formulation, release agent was added per table 1 below. The formulation was pressed in a carver press at 40,000 psi and release forces were measured.

TABLE 1

| Release Aid | Release Force |
|---|---|
| None | 1000 |
| 0.25% mica/0.25% CaStearate | 157 |
| 0.50% mica/0.50% CaStearate | 173 |
| 1.0% CaStearate | 200 |
| 1.0% MgStearate | 175 |
| 1.0% mica | 783 |

EXAMPLE 2

A gas generant formulation of 66.66 wt % sodium azide, 20.88 wt % ferric oxide, 7.07 wt % aluminum oxide, 5.05 wt % sodium nitrate, 0.34 wt % silicon dioxide was prepared. Based on the weight of the generant formulation, release agent was added per table 2 below. The formulation was pressed in a Carver press at 80,000 psi and release forces were measured.

TABLE 2

| Release Aid | Release Force | Burn Rate |
|---|---|---|
| None | 5,679 | 1.27 |
| 1.000% mica | 2,336 | 1.24 |
| 0.375% mica | 2,881 | 1.22 |
| 1.000% calcium stearate (CS) | 480 | 0.76 |
| 0.375% CS | 692 | 1.07 |
| 0.375% CS/0.125% mica | 471 | 1.08 |

For this formulation, a release force of 480 or less and a burn rate of 1.07 or higher is desired. The release force for the 0.375 percent calcium stearate/0.125 percent mica release aid mixture is two percent less than that for the 1.000 percent calcium stearate release aid, and yet it gives a burn rate of 1.08 inches per second (ips)—42 percent greater than the 0.76 ips determined for the one percent Ca stearate release aid. The higher burn rate is desired. The alternative of decreasing the calcium stearate level to 0.375 percent to obtain the same increase in burn rate results in the penalty of a 44 percent increase in the required release force (rising from 480 to 692), which is undesired.

EXAMPLE 3

A gas generant formulation of 68.80 wt % sodium azide, 20.75 wt % ferric oxide, 5.05 wt % sodium nitrate, 3.03 wt % bentonite, 2.02 wt % aluminum oxide, 0.35 wt % silicon dioxide was prepared. Based on the weight of the generant formulation, release agent was added per table 3 below. The formulation was pressed in a Carver press at 80,000 psi and release forces were measured.

TABLE 3

| Release Aid | Release Force | Burn Rate | Density |
|---|---|---|---|
| None | 5,145 | 1.29 | 2.09 |
| 0.75% CS/0.25% mica | 580 | 0.74 | 2.02 |
| 0.50% CS/0.50% mica | 514 | 0.83 | 2.03 |
| 0.25% CS/0.75% mica | 630 | 1.09 | 2.08 |

The data in Table 3 demonstrates the decrease in release force obtainable with this release aid mixture at the one percent additive level. Note the increase in burn rate with increasing mica: calcium stearate ratio. Note also the non-linear, synergistic response of release force with increasing mica: calcium stearate ratio with indicated local minimum for a 1:1 ratio.

EXAMPLE 4

A gas generant formulation of 71.08 wt % CuO, 12.00 wt % guanidine nitrate, 16.92 wt % 5-aminotetrazole (5AT) was prepared. Based on the weight of the generant formulation, release agent was added per table 4 below. The formulation was pressed in a Carver press at 40,000 psi and release forces were measured.

TABLE 4

| Release Aid | Release Force | Burn Rate |
|---|---|---|
| None | 444 | 0.62 |
| 0.5% mica/0.5% CaStearate | 173 | 0.59 |
| 1.0% CaStearate | 129 | 0.53 |
| 1.0% mica | 524 | 0.61 |

What is claimed is:

1. A gas generant comprising a) between about 15 and about 70 wt % fuel, b) between about 20 and about 80 wt % oxidizer, c) at least about 5 wt % of said gas generant composition comprising a metal oxide or metalloid oxide which may either function as an oxidizer and thus be a portion of said oxidizer b) or serve another function, and d) between about 0.05 and about 2 wt % of a release aid comprising a mixture of mica and a salt of a fatty acid.

2. A gas generant in accordance with claim 1 wherein said mica is muscovite mica.

3. A gas generant in accordance with claim i wherein said mica and said salt of a fatty acid are present at ratios of between about 1:4 and about 4:1.

4. A gas generant in accordance with claim 1 wherein said fatty acid salt is a salt of a fatty acid having between about 10 and about 30 carbon atoms.

5. A gas generant in accordance with claim 1 wherein said fatty acid salt has a cation selected from calcium, zinc, and magnesium.

* * * * *

UNITED STATES PATENT AND TRADEMARK OFFICE

CERTIFICATE OF CORRECTION

PATENT NO. : 5,518,054

DATED : May 21, 1996

INVENTOR(S) : Mitson et al.

It is certified that error appears in the above-indentified patent and that said Letters Patent is hereby corrected as shown below:

Col. 4, line 56 of the patent, the letter "i" should be the number "1".

Signed and Sealed this

Fourth Day of March, 1997

Bruce Lehman

*Attest:*

BRUCE LEHMAN

*Attesting Officer*

*Commissioner of Patents and Trademarks*